US011631951B2

(12) United States Patent
Wang et al.

(10) Patent No.: US 11,631,951 B2
(45) Date of Patent: Apr. 18, 2023

(54) PLUG ELECTRICAL CONNECTOR AND RECEPTACLE ELECTRICAL CONNECTOR

(71) Applicant: Acer Incorporated, New Taipei (TW)

(72) Inventors: Yu-Shih Wang, New Taipei (TW); Hung-Jen Su, New Taipei (TW); Chih-Chun Liu, New Taipei (TW); Cheng-Nan Ling, New Taipei (TW); Wen-Chieh Tai, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 17/380,038

(22) Filed: Jul. 20, 2021

(65) Prior Publication Data

US 2022/0085550 A1 Mar. 17, 2022

(30) Foreign Application Priority Data

Sep. 16, 2020 (TW) ..... 109212180

(51) Int. Cl.

| | |
|---|---|
| ***H01R 13/639*** | (2006.01) |
| ***H01R 13/40*** | (2006.01) |
| ***H01R 12/71*** | (2011.01) |
| ***H01R 13/629*** | (2006.01) |
| ***H01R 24/60*** | (2011.01) |
| ***H01R 13/502*** | (2006.01) |

(52) U.S. Cl.

CPC ..... *H01R 13/639* (2013.01); *H01R 12/716* (2013.01); *H01R 13/40* (2013.01); *H01R 13/502* (2013.01); *H01R 13/629* (2013.01); *H01R 24/60* (2013.01)

(58) Field of Classification Search

None

See application file for complete search history.

(56) References Cited

U.S. PATENT DOCUMENTS

| | | | | |
|---|---|---|---|---|
| 4,900,261 | A * | 2/1990 | Gentry | H01R 13/6273 439/353 |
| 7,255,607 | B1 * | 8/2007 | Wu | H01R 27/00 439/660 |
| 7,435,131 | B1 * | 10/2008 | Lee | H01R 12/79 439/495 |
| 7,708,600 | B2 * | 5/2010 | Wu | H01R 27/00 439/660 |
| 9,941,630 | B2 * | 4/2018 | Sato | H01R 13/6272 |
| 10,587,076 | B2 * | 3/2020 | Evans | H01R 13/639 |

* cited by examiner

*Primary Examiner* — Oscar C Jimenez
(74) *Attorney, Agent, or Firm* — JCIPRNET

(57) ABSTRACT

A plug electrical connector including a body and a plurality of cable terminals is provided. The body includes a top surface, two side surfaces opposite to each other, at least one locking slot, and a pair of locking protrusions. The top surface is bordered between the two side surfaces, the locking slot is located on the top surface, and the locking protrusions are located on the side surfaces. The cable terminals penetrate through the body and are arranged between the side surfaces in an axial direction. The plug electrical connector is adapted to be butted to a receptacle electrical connector and is engaged with the receptacle electrical connector with the locking slot and the locking protrusions. A receptacle electrical connector is also provided.

10 Claims, 3 Drawing Sheets

PLUG ELECTRICAL CONNECTOR AND RECEPTACLE ELECTRICAL CONNECTOR

CROSS-REFERENCE TO RELATED APPLICATION

This application claims the priority benefit of Taiwan application serial no. 109212180, filed on Sep. 16, 2020. The entirety of the above-mentioned patent application is hereby incorporated by reference herein and made a part of this specification.

BACKGROUND

Technical Field

The disclosure relates to an electrical connector, and in particular, to a plug electrical connector and a receptacle electrical connector.

Description of Related Art

An electrical connector is an indispensable device in an electronic apparatus and is configured to enable electronic members in the electronic apparatus to transmit power or signals. As such, an electrical connector regarding its physical structure, not only needs to meet requirements of relevant electrical characteristics, but also needs to exhibit effects of weather resistance, being not easy to be detached, and being easy to operate.

Taking a notebook computer as an example herein, as the body of the notebook computer evolves towards a light and thin design, the size of the electrical connector, serving as an electrical connector between different electronic members inside the body, also needs to be further reduced along with the body. In this way, in an assembling process, the notebook computer often faces a situation that the electrical connector is limited in size and lacks stability. As a result, operators need to additionally provide attaching or supporting auxiliary materials to ensure the connection strength and stability of the electrical connector. However, the originally-aimed size reduction goal may not be achieved. In addition, the auxiliary materials and related operations undoubtedly increase assembly costs and consumed working hours.

SUMMARY

The disclosure provides a plug electrical connector and a receptacle electrical connector exhibiting enhanced bonding strength when the electrical connectors are butted through engagement structures corresponding to each other.

A plug electrical connector provided by the disclosure includes a body and a plurality of cable terminals. The body includes a top surface, two side surfaces opposite to each other, at least one locking slot, and a pair of locking protrusions. The top surface is bordered between the two side surfaces, the locking slot is located on the top surface, and the locking protrusions are located on the side surfaces. The cable terminals penetrate through the body respectively and are arranged between the side surfaces in an axial direction. The plug electrical connector is adapted to be butted to a receptacle electrical connector and is engaged with the receptacle electrical connector with the locking slot and the locking protrusions.

A receptacle electrical connector provide by the disclosure is adapted to be disposed on a circuit board. The receptacle electrical connector includes a body and a plurality of terminals. The body includes a top plate, two side plates opposite to each other, at least one locking protrusion, and a pair of locking slots. The top plate is bordered between the two side plates, the locking protrusion is located on the top plate, and the locking slots are located on the two side plates. The terminals penetrate through the body and are welded to the circuit board. The terminals are arranged between the two side plates in an axial direction. The receptacle electrical connector is adapted to be butted to a plug electrical connector and is engaged with the plug electrical connector with the locking protrusion and the locking slots.

Based on the foregoing, the locking slot and the locking protrusion are provided on both the plug electrical connector and the receptacle electrical connector and are configured to be butted to the receptacle electrical connector or the plug electrical connector. For the plug electrical connector, the locking slot is located on the top surface of the body, and the pair of locking protrusions are located on the two side surfaces opposite to each other of the body. For the receptacle electrical connector, the locking protrusion is located on the top plate of the body, and the pair of locking slots are located on the two side plates opposite to each other of the body.

In this way, when the receptacle electrical connector and the plug electrical connector are butted to each other, the locking protrusion and the locking slot located on the two side surfaces opposite to each other have opposite engagement directions, and a stable locking effect is therefor provided. The locking protrusion located on the top plate and the locking slot located on the top surface may provide locking and abutting effects from top to bottom on the bodies. As such, when the receptacle electrical connector and the plug electrical connector are engaged, an effect of abutting the electrical connector on the circuit board may also be achieved. Accordingly, the receptacle electrical connector and the plug electrical connector may achieve stable engagement through the butting structure of the locking protrusion and the locking slot.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
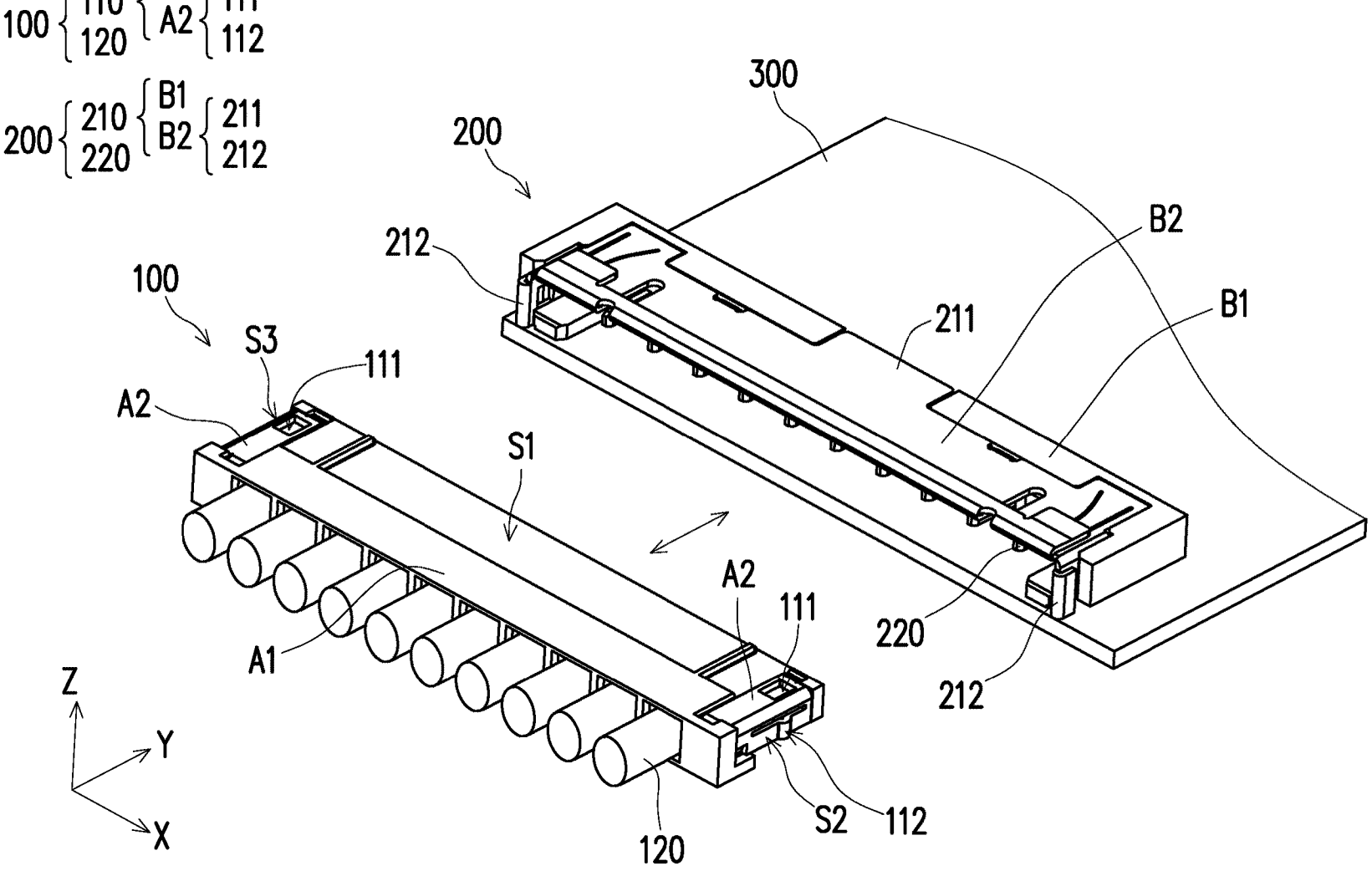
FIG. 1 is a schematic view of a connector assembly according to an embodiment of the disclosure.

FIG. 1 is a schematic view of a connector assembly according to an embodiment of the disclosure. In this embodiment, FIG. 1 is a schematic view of butting between a plug electrical connector 100 and a receptacle electrical connector 200, and the double-headed arrow in the figure is a plug-in/out axial direction. Herein, rectangular coordinates X-Y-Z are also provided to facilitate subsequent description of components, and the plug-in/out axial direction is substantially consistent with a Y-axis axial direction.

In this embodiment, the plug electrical connector 100 includes a body 110 and a plurality of cable terminals 120, and the cable terminals 120 are only partially shown as an example. The body 110 includes a top surface S1, two side surfaces S2 and S3 opposite to each other, a locking slot 111, and a pair of locking protrusions 112. Due to limitation of the visual angle, only the locking protrusion 112 located on the side surface S2 may be recognized, and the other side surface S3 is not shown, but also has the same structural features. The top surface S1 is bordered between the two side surfaces S2 and S3, the locking slot 111 is located on the top surface S1, and the locking protrusions 112 are located on the side surfaces S2 and S3. The cable terminals 120 penetrate through the body 110 respectively along a Y axis. The cable terminals 120 are arranged between the side surfaces S2 and S3 in an X-axis axial direction. The plug electrical connector 100 is adapted to be butted to the receptacle electrical connector 200 and is engaged with the receptacle electrical connector 200 with the locking slot 111 and the locking protrusions 112.

Herein, the body 110 includes an electrical insulation member A1 and a pair of conductive members A2. The cable terminals 120 penetrate through the electrical insulation member A1, the conductive members A2 cover two different surfaces of the electrical insulation member A1 respectively (the conductive member A2 on the right side in the figure covers a right side surface of the body 110 to form the side surface S2, and also covers a part of the top surface S1, and the conductive member A2 on the left side in the figure covers a left side surface of the body 110 to form the side surface S3, and also covers a part of the top surface S1), and the locking protrusion 112 is substantially located on an elastic arm structure of the conductive member A2. In this embodiment, the body 110 may bond the conductive member A2 to the electrical insulation member A1 through insert molding.

Figure 2A:
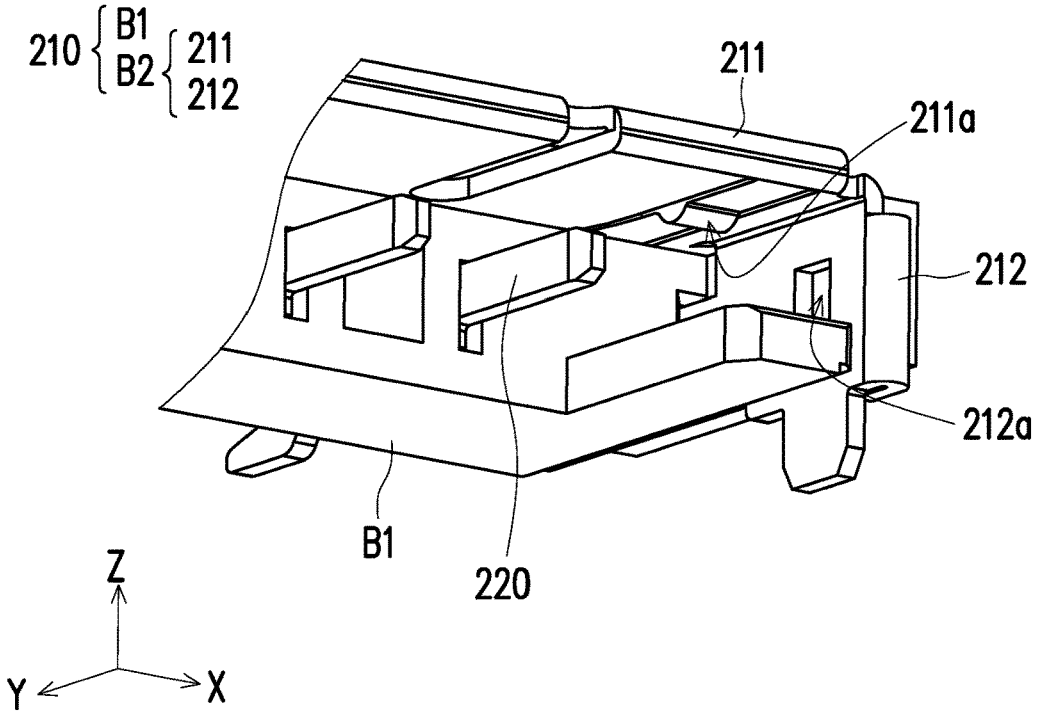
FIG. 2A and FIG. 2B are partial enlarged views illustrating a receptacle electrical connector at different visual angles.
Figure 2B:
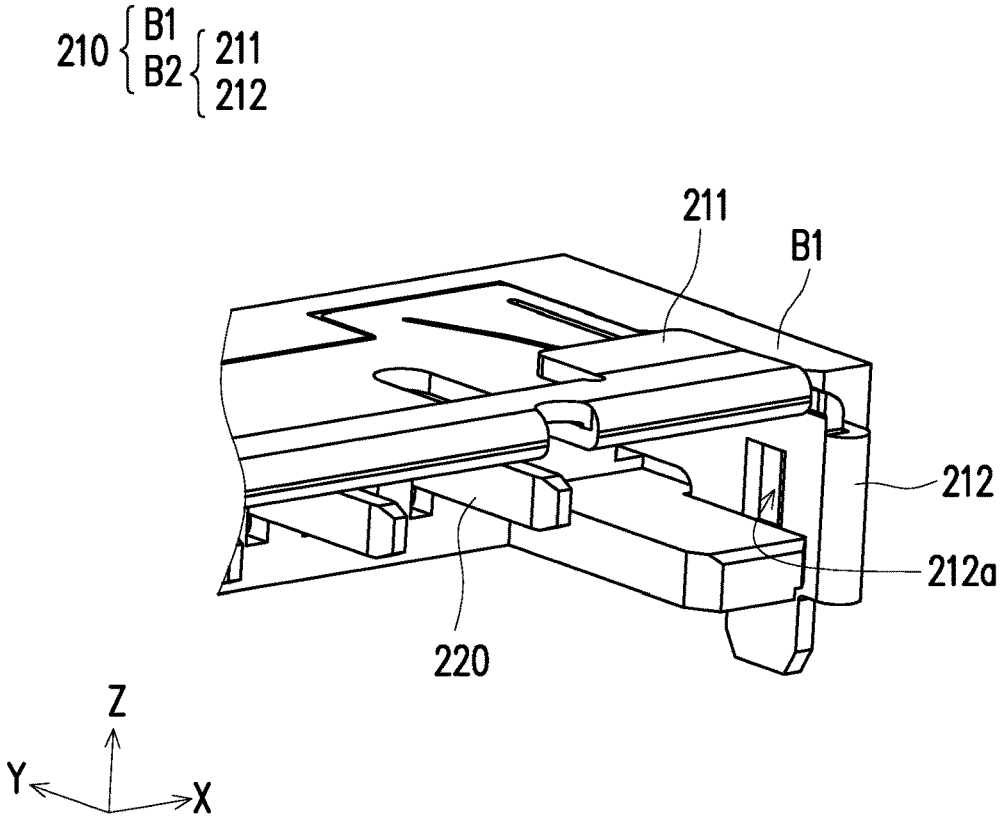

FIG. 2A and FIG. 2B are partial enlarged views illustrating a receptacle electrical connector at different visual angles. Referring to FIG. 1, FIG. 2A, and FIG. 2B together, the receptacle electrical connector 200 in this embodiment is disposed on a circuit board 300, and the receptacle electrical connector 200 includes a body 210 and a plurality of terminals 220. The body 210 includes a top plate 211, two side plates 212 opposite to each other, a locking protrusion 211*a*, and a pair of locking slots 212*a*. The top plate 211 is bordered between the two side plates 212, the locking protrusion 211*a* is located on the top plate 211, and the locking slots 212*a* are located on the two side plates 212. The terminals 220 penetrate through the body 210, are welded to the circuit board 300, and are arranged between the two side plates 212 in an X-axis axial direction. The receptacle electrical connector 200 is adapted to be butted to a plug electrical connector 100 and is engaged with the plug electrical connector 100 with the locking protrusion 211*a* and the locking slots 212*a*. Herein, a reverse folding structure is used as a reinforcing means on a front end that is of either the top plate 211 or the side plate 212 and that is close to an interface, to effectively improve the anti-plug-in/out capability of the receptacle electrical connector 200. In addition, a dual in-line package (DIP) form is also used between the receptacle electrical connector 200 and the circuit board 300, to further enhance the tensile strength of the receptacle electrical connector 200.

Similarly, the body 210 of the receptacle electrical connector 200 includes an electrical insulation member B1 and a conductive member B2. The terminals 220 penetrate through the electrical insulation member B1 along the Y axis, and the conductive member B2 has the top plate 211, the two side plates 212, the locking protrusion 211*a*, and the locking slots 212*a*. The conductive member B2 extends in the X-axis axial direction and crosses the electrical insulation member B1. In this embodiment, the body 210 may alternatively bond the conductive member B2 to the electrical insulation member B1 through insert molding.

Figure 3A:
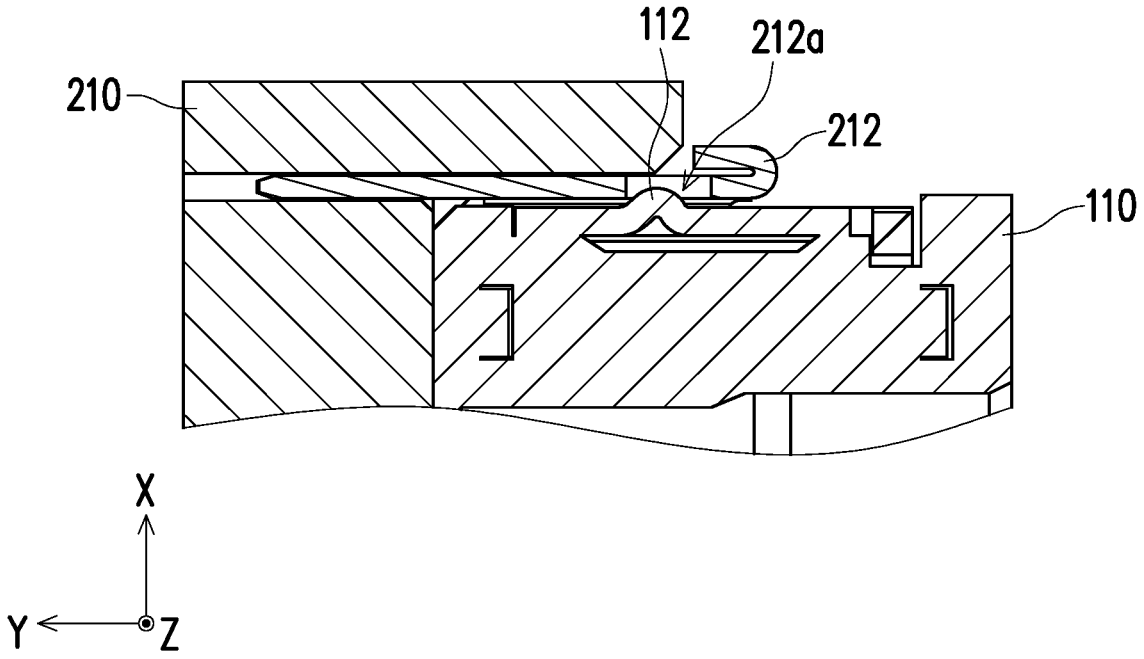
FIG. 3A and FIG. 3B are respectively partial cross-sectional views illustrating electrical connectors butted to each other.
Figure 3B:
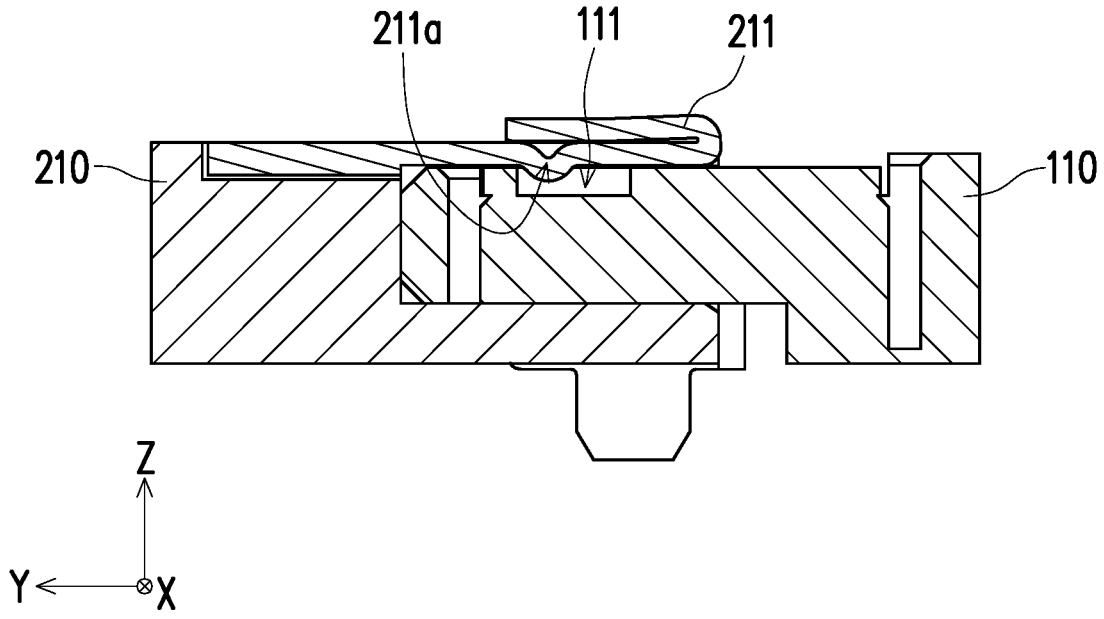

FIG. 3A and FIG. 3B are respectively partial cross-sectional views illustrating electrical connectors butted to each other. Referring to FIG. 1, FIG. 3*a*, and FIG. 3B together, based on the foregoing component configuration, when the plug electrical connector 100 is butted to the receptacle electrical connector 200, the locking protrusion 112 is correspondingly engaged with the locking slot 212*a*, and the locking protrusion 211*a* is correspondingly engaged with the locking slot 111. In this way, the plug electrical connector 100 and the receptacle electrical connector 200 may be stably locked together. Because the locking protrusion 112 and the locking slot 212*a* are located on opposite sides of the bodies 110 and 210 respectively, engagement forces thereof are opposite to each other along the X axis, and the engagement forces of the structure are thereby enhanced. Moreover, the locking protrusion 211*a* located on the top plate 211 and the locking slot 111 located on the top surface S1 may provide locking and abutting effects from top to bottom (in a negative Z-axis direction) on the bodies 110 and 210, so that when the receptacle electrical connector 200 and the plug electrical connector 100 are engaged, an effect of abutting the electrical connector on the circuit board 300 may also be achieved.

Referring to FIG. 1 again, in the plug electrical connector 100 in this embodiment, the locking slot 111 is located outside a range of an orthographic projection of the cable terminals 120 on the top surface S1, that is, the orthographic projection of the cable terminals 120 on the top surface S1 is between the pair of locking slots 111, that is, the pair of conductive members A2 are located on opposite sides of the cable terminals 120 in the X-axis axial direction and form the two side surfaces S2 and S3 opposite to each other respectively. Referring to FIG. 1, FIG. 2A, FIG. 2B again, similarly, for the receptacle electrical connector 200, the locking protrusion 211*a* is located outside a range of an orthographic projection of the terminals 220 on the top plate 211, that is, the orthographic projection of the terminals 220 on the top plate 211 is located between the pair of locking protrusions 211*a*.

Based on the foregoing, in the foregoing embodiments of the disclosure, the locking slot and the locking protrusion are provided on both the plug electrical connector and the receptacle electrical connector and are configured to be butted to the receptacle electrical connector or the plug electrical connector. For the plug electrical connector, the locking slot is located on the top surface of the body, and the pair of locking protrusions are located on the two side surfaces opposite to each other of the body. For the receptacle electrical connector, the locking protrusion are located on the top plate of the body, and the pair of locking slots are located on the two side plates opposite to each other of the body.

In this way, when the receptacle electrical connector and the plug electrical connector are butted to each other, the locking protrusion and the locking slot located on the two side surfaces opposite to each other have opposite engagement directions, and a stable locking effect is therefore provided. The locking protrusion located on the top plate and the locking slot located on the top surface may provide locking and abutting effects from top to bottom on the bodies, so that when the receptacle electrical connector and the plug electrical connector are engaged, an effect of abutting the electrical connector on the circuit board may also be achieved. Accordingly, the receptacle electrical connector and the plug electrical connector may achieve stable engagement through the butting structure of the locking protrusion and the locking slot.

In addition, the locking protrusion and the locking slot may also provide a clear operation feeling and a positioning effect for a user in a corresponding engagement process, so that a situation that the user cannot determine whether the electrical connectors are butted already or a force is applied improperly is avoided. For example, in an action of withdrawing the plug electrical connector from the receptacle electrical connector, the user needs to first apply a force to the two side surfaces opposite to each other of the body of the plug electrical connector, to withdraw the locking protrusions from the locking slot, and then, an action of withdrawing the plug electrical connector may be performed. This clearly specifies that the user needs to pull the plug electrical connector out through the specified withdrawal action, thereby prolonging a service life of the electrical connector through safe operation. Similarly, in the process of inserting the plug electrical connector into the receptacle electrical connector, because the locking slot may provide the engaging and positioning effects of the locking protrusion, due to the clear feeling, the user avoids a situation of a mixed damage caused by the improper force application.

On the other hand, the locking protrusion and the locking slot of either the plug electrical connector or the receptacle electrical connector are located on the opposite sides of the whole structure in an arrangement direction of the terminals or the cable terminals. Therefore, the butting of the electrical connectors is not affected, and the existing structural parts are processed to form a required structure, and therefore, manufacturing costs of the electrical connectors are not considerably affected. On the contrary, additional arrangement of auxiliary materials is effectively prevented, and the manufacturing materials and labor costs are therefore effectively reduced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A plug electrical connector, comprising:

a body, comprising a top surface, two side surfaces opposite to each other, at least one locking slot, and a pair of locking protrusions, wherein the top surface is bordered between the two side surfaces, the at least one locking slot is located on the top surface, and the pair of locking protrusions are located on the two side surfaces; and a plurality of cable terminals, penetrating through the body, arranged between the two side surfaces in an axial direction, wherein the plug electrical connector is adapted to be butted to a receptacle electrical connector, the receptacle electrical connector has two side plates opposite to each other, each of the two side plates has a U-shaped end portion, and the plug electrical connector is engaged with the receptacle electrical connector with the at least one locking slot and the pair of locking protrusions.

2. The plug electrical connector according to claim 1, wherein the at least one locking slot is located outside a range of an orthographic projection of the cable terminals on the top surface.

3. The plug electrical connector according to claim 1, wherein the body comprises a pair of locking slots, and an orthographic projection of the cable terminals on the top surface is located between the pair of locking slots.

4. The plug electrical connector according to claim 1, wherein the body comprises an electrical insulation member and at least one conductive member, the cable terminals penetrate through the electrical insulation member, the conductive member covers two different surfaces of the electrical insulation member, and the pair of locking protrusions are located on an elastic arm structure of the conductive member.

5. The plug electrical connector according to claim 4, wherein the body comprises a pair of conductive members located on opposite sides of the cable terminals in the axial direction, and portions of the pair of conductive members form the two side surfaces.

6. A receptacle electrical connector, adapted to be disposed on a circuit board, wherein the receptacle electrical connector comprises:

a body, comprising a top plate, two side plates opposite to each other, at least one locking protrusion, and a pair of locking slots, wherein the top plate is bordered between the two side plates, the at least one locking protrusion is located on the top plate, the pair of locking slots are located on the two side plates, and each of the two side plates has a U-shaped end portion; and a plurality of terminals, penetrating through the body, welded to the circuit board, arranged between the two side plates in an axial direction, wherein the receptacle electrical connector is adapted to be butted to a plug electrical connector and is engaged with the plug electrical connector with the at least one locking protrusion and the pair of locking slots.

7. The receptacle electrical connector according to claim 6, wherein the at least one locking protrusion is located outside a range of an orthographic projection of the terminals on the top plate.

8. The receptacle electrical connector according to claim 6, wherein the body comprises a pair of locking protrusions, and an orthographic projection of the terminals on the top plate is located between the pair of locking protrusions.

9. The receptacle electrical connector according to claim 6, wherein the body comprises an electrical insulation member and a conductive member, the terminals penetrate through the electrical insulation member, and the conductive member comprises the top plate, the two side plates, the at least one locking protrusion, and the pair of locking slots.

10. The receptacle electrical connector according to claim 9, wherein the conductive member extends in the axial direction and crosses opposite sides of the electrical insulation member.

* * * * *